US011276916B2

(12) United States Patent
Kim et al.

(10) Patent No.: US 11,276,916 B2
(45) Date of Patent: Mar. 15, 2022

(54) ELECTRONIC DEVICE COMPRISING ANTENNA MODULE

(71) Applicant: Samsung Electronics Co., Ltd., Suwon-si (KR)

(72) Inventors: Dongyeon Kim, Suwon-si (KR); Ahmed Hussain, Suwon-si (KR); Seongjin Park, Suwon-si (KR); Sehyun Park, Suwon-si (KR); Sumin Yun, Suwon-si (KR); Woomin Jang, Suwon-si (KR); Myunghun Jeong, Suwon-si (KR); Jehun Jong, Suwon-si (KR); Jaehoon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/750,541

(22) Filed: Jan. 23, 2020

(65) Prior Publication Data

US 2020/0243948 A1 Jul. 30, 2020

(30) Foreign Application Priority Data

Jan. 25, 2019 (KR) ..... 10-2019-0009581

(51) Int. Cl.
*H01Q 13/10* (2006.01)
*H01Q 9/04* (2006.01)
(Continued)

(52) U.S. Cl.
CPC ..... *H01Q 1/243* (2013.01); *H01Q 1/38* (2013.01); *H01Q 9/0407* (2013.01)

(58) Field of Classification Search
None
See application file for complete search history.

(56) References Cited

U.S. PATENT DOCUMENTS 7,224,313 B2 5/2007 McKinzie, III et al.
7,342,469 B2 3/2008 Lee et al.
(Continued)

FOREIGN PATENT DOCUMENTS

KR 16-2006-0061056 A 6/2006
WO 2018/125240 A1 7/2018

OTHER PUBLICATIONS

International Search Report with Written Opinion dated May 19, 2020; International Appln. No. PCT/KR2020/001216.
(Continued)

*Primary Examiner* — Pablo N Tran
(74) *Attorney, Agent, or Firm* — Jefferson IP Law, LLP

(57) ABSTRACT

An electronic device is provided. The electronic device includes a housing, a display exposed through at least part of the first plate, an antenna structure body disposed inside the housing and including a first surface facing the non-conductive portion and a second surface facing away from the first surface, a spacer structure coupled to the first surface or integrally formed with the antenna structure body to protrude from the first surface without overlapping with the conductive pattern when viewed from above the first surface, and a wireless communication circuit electrically connected to the conductive pattern and configured to transmit or receive a signal. At least part of the first plate, the second plate, or the side member includes a non-conductive portion. The antenna structure body includes at least one conductive pattern disposed between the first surface and the second surface or on the first surface.

19 Claims, 12 Drawing Sheets

(51) Int. Cl.
*H01Q 1/38* (2006.01)
*H01Q 1/24* (2006.01)

(56) References Cited

U.S. PATENT DOCUMENTS

| | | | | |
|---|---|---|---|---|
| 7,593,704 | B2 | 9/2009 | Pinel et al. | |
| 7,864,113 | B2 | 1/2011 | Pinel et al. | |
| 9,391,370 | B2 | 7/2016 | Tzanidis et al. | |
| 10,224,607 | B2 | 3/2019 | Kim et al. | |
| 10,886,606 | B2 | 1/2021 | Kamgaing et al. | |
| 2002/0036589 | A1 | 3/2002 | Taira et al. | |
| 2005/0024268 | A1 | 2/2005 | McKinzie, III et al. | |
| 2006/0114083 | A1 | 6/2006 | Lee et al. | |
| 2006/0223439 | A1 | 10/2006 | Pinel et al. | |
| 2009/0040115 | A1* | 2/2009 | Zhang | H01Q 1/243 343/702 |
| 2010/0035539 | A1* | 2/2010 | Yoshida | H01Q 9/285 455/1 |
| 2010/0134375 | A1 | 6/2010 | Chen et al. | |
| 2011/0120628 | A1 | 5/2011 | Pinel et al. | |
| 2013/0222198 | A1* | 8/2013 | Kojima | H01Q 1/40 343/788 |
| 2013/0250504 | A1* | 9/2013 | Choi | G06F 1/203 361/679.26 |
| 2015/0194724 | A1 | 7/2015 | Yepes et al. | |
| 2015/0381229 | A1 | 12/2015 | Tzanidis et al. | |
| 2017/0047638 | A1 | 2/2017 | Kim et al. | |
| 2018/0090851 | A1* | 3/2018 | Feldman | H01Q 21/065 |
| 2018/0090852 | A1* | 3/2018 | Dufilie | H01Q 1/48 |
| 2019/0081404 | A1* | 3/2019 | Jeon | H01Q 9/0414 |
| 2019/0252792 | A1* | 8/2019 | Maruthamuthu | H01Q 1/48 |
| 2019/0288382 | A1 | 9/2019 | Kamgaing et al. | |

OTHER PUBLICATIONS

Extended European Search Report dated Jan. 4, 2022, issued in European Patent Application No. 20744660.0-1205.

* cited by examiner

ELECTRONIC DEVICE COMPRISING ANTENNA MODULE

CROSS-REFERENCE TO RELATED APPLICATION(S)

This application is based on and claims priority under 35 U.S.C. § 119(a) of a Korean patent application number 10-2019-0009581, filed on Jan. 25, 2019, in the Korean Intellectual Property Office, the disclosure of which is incorporated by reference herein in its entirety.

BACKGROUND

1. Field

The disclosure relates to an electronic device including an antenna module.

2. Description of Related Art

With the rapid increase in mobile traffic, the next generation communication technology based on high-band frequency (e.g., 5th generation (5G) or wireless gigabit alliance (WiGig)) is being developed. For example, the signal in high-band frequency may include a millimeter wave having the frequency band of 3 GHz to 300 GHz. When the high-band frequency is used, a wavelength may become short, and thus, an antenna and a device may become small-sized and/or lightweight.

The above information is presented as background information only to assist with an understanding of the disclosure. No determination has been made, and no assertion is made, as to whether any of the above might be applicable as prior art with regard to the disclosure.

SUMMARY

As high-band frequencies are used, many antennas may be mounted in the same area thank to the short wavelength relatively, on the other hand, because the directivity of the radio waves becomes strong and the propagation path loss seriously occurs, the propagation characteristics may be deteriorated.

For example, the configuration capable of affecting the performance of the antenna module may be disposed adjacent to the surrounding area of the antenna module using a millimeter band of 20 GHz or more.

Aspects of the disclosure are to address at least the above-mentioned problems and/or disadvantages and to provide at least the advantages described below. Accordingly, an aspect of the disclosure is to provide an electronic device capable of forming a specified air-cavity with an antenna module and at least one configuration.

Additional aspects will be set forth in part in the description which follows and, in part, will be apparent from the description, or may be learned by practice of the presented embodiments.

In accordance with an aspect of the disclosure, an electronic device is provided. The electronic device includes a housing including a first plate, a second plate disposed to face away from the first plate, and a side member surrounding a space between the first plate and the second plate and coupled with the second plate or integrally formed with the second plate, a display exposed through at least part of the first plate, an antenna structure body disposed inside the housing and including a first surface facing the non-conductive portion and a second surface facing away from the first surface, a spacer structure coupled to the first surface or integrally formed with the antenna structure body to protrude from the first surface without overlapping with the conductive pattern when viewed from above the first surface, and a wireless communication circuit electrically connected to the conductive pattern and configured to transmit or receive a signal. At least part of the first plate, the second plate, or the side member may include a non-conductive portion. The antenna structure body may include at least one conductive pattern disposed between the first surface and the second surface or on the first surface.

In accordance with another aspect of the disclosure, an electronic device is provided. The electronic device includes a housing, a display disposed on a front surface of the housing, a rear cover disposed on a rear surface of the housing, an antenna module positioned between the display and the rear cover and supporting a frequency band operated in at least a 5G communication scheme, and a spacer structure interposed between the antenna module and the rear cover.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications, of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
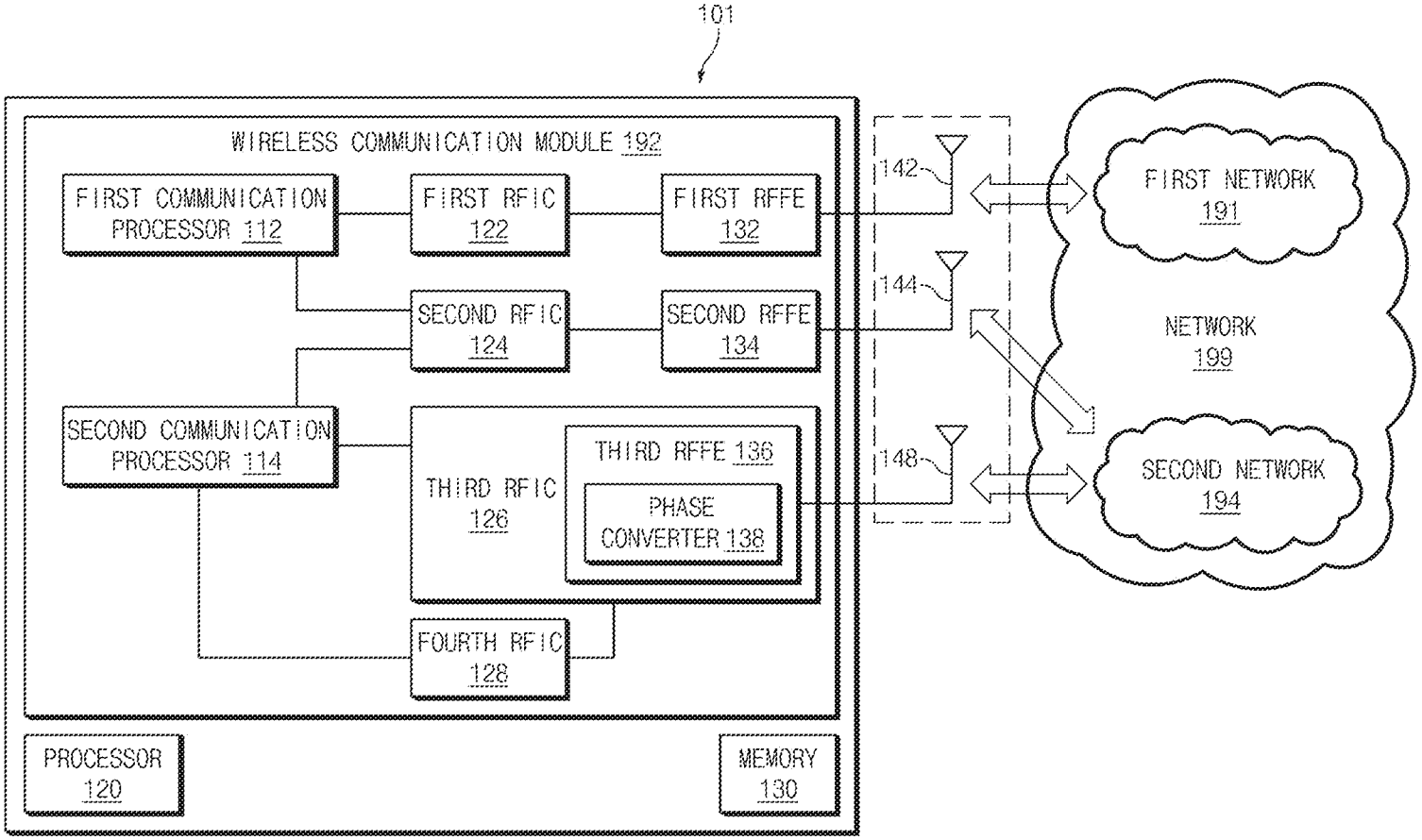
FIG. 1 is a block diagram of an electronic device for supporting legacy network communication and 5G network communication, according to an embodiment of the disclosure.

FIG. 1 is a block diagram of an electronic device for supporting legacy network communication and 5G network communication, according to an embodiment of the disclosure.

Referring to FIG. 1, an electronic device 101 may include a first communication processor 112, a second communication processor 114, a first radio frequency integrated circuit (RFIC) 122, a second RFIC 124, a third RFIC 126, a fourth RFIC 128, a first radio frequency front end (RFFE) 132, a second RFFE 134, a first antenna module 142, a second antenna module 144, and an antenna 148. The electronic device 101 may further include a processor 120 and a memory 130. The network 199 may include a first network 191 (e.g., a first cellular network) and a second network 194 (e.g., a second cellular network). According to another embodiment, the electronic device 101 may further include at least one component of the components illustrated in FIG. 1, and the network 199 may further include at least another network. According to an embodiment, the first communication processor 112, the second communication processor 114, the first RFIC 122, the second RFIC 124, the fourth RFIC 128, the first RFFE 132, and the second RFFE 134 may form at least part of the wireless communication module 192. According to another embodiment, the fourth RFIC 128 may be omitted or included as the part of the third RFIC 126.

The first communication processor 112 may establish a communication channel for a band to be used for wireless communication with the first network 191 and may support legacy network communication through the established communication channel. According to various embodiments, the first network may be a legacy network including a 2nd generation (2G), 3rd generation (3G), 4th generation (4G), or long term evolution (LTE) network. The second communication processor 114 may support the establishment of a communication channel corresponding to a specified band (e.g., about 6 GHz~ about 60 GHz) among bands to be used for wireless communication with the second network 194 and 5G network communication via the established communication channel According to various embodiments, the second network 194 may be a 5G network defined in 3rd generation partnership project (3GPP). Additionally, according to an embodiment, the first communication processor 112 or the second communication processor 114 may establish a communication channel corresponding to another specified band (e.g., approximately 6 GHz or lower) of the bands to be used for wireless communication with the second network 194 and may support 5G network communication through the established communication channel. According to an embodiment, the first communication processor 112 and the second communication processor 114 may be implemented within a single chip or a single package. According to various embodiments, the first communication processor 112 or the second communication processor 114 may be implemented within a single chip or a single package together with the processor 120, the auxiliary processor (not shown), or the wireless communication module 192.

In the case of transmitting a signal, the first RFIC 122 may convert a baseband signal generated by the first communication processor 112 into a radio frequency (RF) signal of about 700 MHz to about 3 GHz that is used in the first network 191. In the case of receiving a signal, an RF signal may be obtained from the first network 191 (e.g., a legacy network) through an antenna (e.g., the first antenna module 142) and may be pre-processed through an RFFE (e.g., the first RFFE 132). The first RFIC 122 may convert the pre-processed RF signal into a baseband signal so as to be processed by the first communication processor 112.

In the case of transmitting a signal, the second RFIC 124 may convert a baseband signal generated by the first communication processor 112 or the second communication processor 114 into an RF signal (hereinafter referred to as a "5G Sub6 RF signal") in a Sub6 band (e.g., about 6 GHz or lower) used in the second network 194 (e.g., a 5G network). In the case of receiving a signal, the 5G Sub6 RF signal may be obtained from the second network 194 (e.g., a 5G network) through an antenna (e.g., the second antenna module 144) and may be pre-processed through an RFFE (e.g., the second RFFE 134). The second RFIC 124 may convert the pre-processed 5G Sub6 RF signal into a baseband signal so as to be processed by a communication processor corresponding to the 5G Sub6 RF signal from among the first communication processor 112 or the second communication processor 114.

The third RFIC 126 may convert a baseband signal generated by the second communication processor 114 into an RF signal (hereinafter referred to as a "5G Above6 RF signal") in a 5G Above6 band (e.g., approximately 6 GHz to approximately 60 GHz) to be used in the second network 194 (e.g., a 5G network). In the case of receiving a signal, the 5G Above6 RF signal may be obtained from the second network 194 (e.g., a 5G network) through an antenna (e.g., the antenna 148) and may be pre-processed through a third RFFE 136, which may include a phase converter 138. The third RFIC 126 may convert the preprocessed 5G Above6 RF signal to a baseband signal so as to be processed by the second communication processor 114. According to an embodiment, the third RFFE 136 may be implemented as a part of the third RFIC 126.

According to an embodiment, the electronic device 101 may include the fourth RFIC 128 independent of the third RFIC 126 or as at least part thereof. In this case, the fourth RFIC 128 may convert a baseband signal generated by the second communication processor 114 into an RF signal (hereinafter referred to as an "IF signal") in an intermediate frequency band (e.g., ranging from about 9 GHz to about 11 GHz) and may provide the IF signal to the third RFIC 126. The third RFIC 126 may convert the IF signal into the 5G Above6 RF signal. In the case of receiving a signal, the 5G Above6 RF signal may be received from the second network 194 (e.g., a 5G network) through an antenna (e.g., the antenna 148) and may be converted into an IF signal by the third RFIC 126. The fourth RFIC 128 may convert the IF signal to the baseband signal such that the second communication processor 114 is capable of processing the baseband signal.

According to an embodiment, the first RFIC 122 and the second RFIC 124 may be implemented as at least part of a single chip or a single package. According to an embodiment, the first RFFE 132 and the second RFFE 134 may be implemented as at least part of a single chip or a single package. According to an embodiment, at least one antenna module of the first antenna module 142 or the second antenna module 144 may be omitted or may be coupled to another antenna module and then may process RF signals of a plurality of corresponding bands.

According to an embodiment, the third RFIC 126 and the antenna 148 may be disposed on the same substrate to form the third antenna module 146. For example, the wireless communication module 192 or the processor 120 may be disposed on a first substrate (e.g., a main printed circuit board (PCB)). In this case, the third RFIC 126 may be disposed in a partial region (e.g., a bottom surface) of a second substrate (e.g., sub PCB) separately of the first substrate; the antenna 148 may be disposed in another partial region (e.g., an upper surface), and thus the third antenna module 146 may be formed. According to an embodiment, the antenna 148 may include, for example, an antenna array to be used for beamforming. As the third RFIC 126 and the antenna 148 are disposed at the same substrate, it may be possible to decrease a length of a transmission line between the third RFIC 126 and the antenna 148. The decrease in the transmission line may make it possible to reduce the loss (or attenuation) of a signal in a high-frequency band (e.g., approximately 6 GHz to approximately 60 GHz) used for the 5G network communication due to the transmission line. As such, the electronic device 101 may improve the quality or speed of communication with the second network 194 (e.g., a 5G network).

The second network 194 (e.g., a 5G network) may be used independently of the first network 191 (e.g., a legacy network) (e.g., stand-alone (SA)) or may be used in conjunction with the first network 191 (e.g., non-stand-alone (NSA)). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may then access an external network (e.g., Internet) under control of the core network (e.g., an evolved packed core (EPC)) of the legacy network. Protocol information (e.g., LTE protocol information) for communication with the legacy network or protocol information (e.g., New Radio (NR) protocol information) for communication with the 5G network may be stored in the memory 130 so as to be accessed by any other component (e.g., the processor 120, the first communication processor 112, or the second communication processor 114).

Figures 2A, 2B:
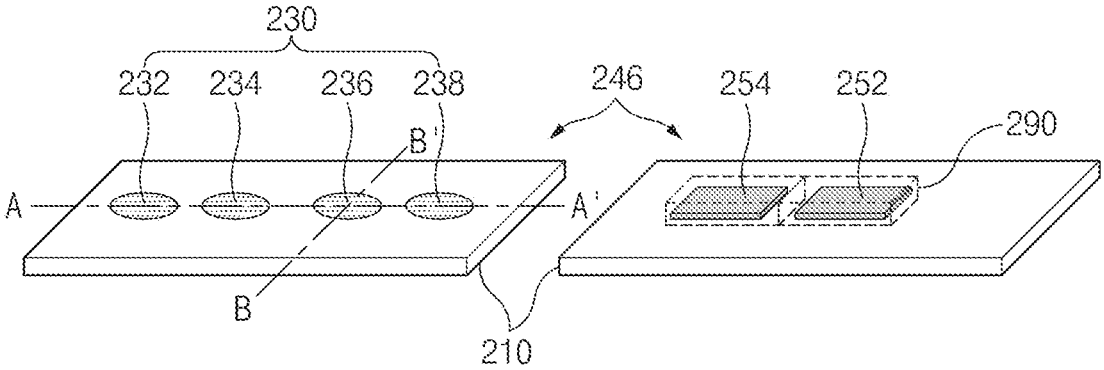
FIGS. 2A, 2B, and 2C illustrate a third antenna module described with reference to FIG. 1 according to various embodiments of the disclosure.
Figure 2C:
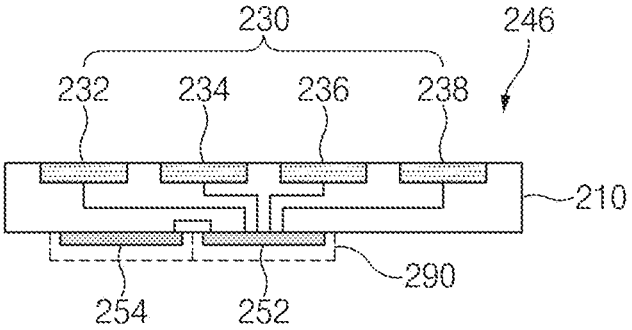

FIGS. 2A, 2B, and 2C illustrate a third antenna module described with reference to FIG. 1 according to various embodiments of the disclosure. FIG. 2A is a perspective view of the third antenna module 146 when viewed from one side. FIG. 2B is a perspective view of the third antenna module 146 when viewed from another side. FIG. 2C is a cross-sectional view of the third antenna module 146 taken along a line A-A'.

Referring to FIG. 2A, in an embodiment, the third antenna module 146 may include a printed circuit board 210, an antenna array 230, a RFIC 252, a power manage integrated circuit (PMIC) 254, and a module interface. Selectively, the third antenna module 146 may further include a shielding member 290. In various embodiments, at least one of the above components may be omitted, or at least two of the components may be integrally formed.

The printed circuit board 210 may include a plurality of conductive layers and a plurality of non-conductive layers, and the conductive layers and the non-conductive layers may be alternately stacked. The printed circuit board 210 may provide electrical connection with various electronic components disposed on the printed circuit board 210 or on the outside, by using wires and conductive vias formed in the conductive layers.

The antenna array 230 (e.g., 148 of FIG. 1) may include a plurality of antenna elements 232, 234, 236, and 238 (or patch antennas) disposed to form a directional beam. As shown in FIGS. 2A, 2B, and 2C, the antenna elements may be formed on a first surface of the printed circuit board 210 as illustrated. According to another embodiment, the antenna array 230 may be formed within the printed circuit board 210. According to embodiments, the antenna array 230 may include a plurality of antenna arrays (e.g., a dipole antenna array and/or a patch antenna array), the shapes or kinds of which are identical or different.

The RFIC 252 (e.g., 126 of FIG. 1) may be disposed on another region (e.g., a second surface facing away from the first surface) of the printed circuit board 210 so as to be spaced from the antenna array. The RFIC may be configured to process a signal in the selected frequency band, which is transmitted/received through the antenna array 230. According to an embodiment, in the case of transmitting a signal, the RFIC 252 may convert a baseband signal obtained from a communication processor (not illustrated) into an RF signal. In the case of receiving a signal, the RFIC 252 may convert an RF signal received through the antenna array 230 into a baseband signal and may provide the baseband signal to the communication processor.

According to another embodiment, in the case of transmitting a signal, the RFIC 252 may up-convert an IF signal (e.g., approximately 9 GHz to approximately 11 GHz) obtained from an intermediate frequency integrated circuit (IFIC) (e.g., 128 of FIG. 1) into an RF signal. In the case of receiving a signal, the RFIC 252 may down-convert an RF signal obtained through the antenna array 230 into an IF signal and may provide the IF signal to the IFIC.

The PMIC 254 may be disposed on another region (e.g., the second surface) of the printed circuit board 210, which is spaced from the antenna array. The PMIC may be supplied with a voltage from a main PCB (not illustrated) and may provide a power necessary for various components (e.g., the RFIC 252) on an antenna module.

The shielding member 290 may be disposed at a portion (e.g., on the second surface) of the printed circuit board 210 such that at least one of the RFIC 252 or the PMIC 254 is electromagnetically shielded. According to an embodiment, the shielding member 290 may include a shield can.

Although not illustrated in FIGS. 2A, 2B, and 2C, in various embodiments, the third antenna module 146 may be electrically connected with another printed circuit board (e.g., a main circuit board) through a module interface. The module interface may include a connection member, for example, a coaxial cable connector, a board to board connector, an interposer, or a flexible printed circuit board (FPCB). The RFIC 252 and/or the PMIC 254 of the third antenna module 246 may be electrically connected with the printed circuit board through the connection member.

Figure 3:
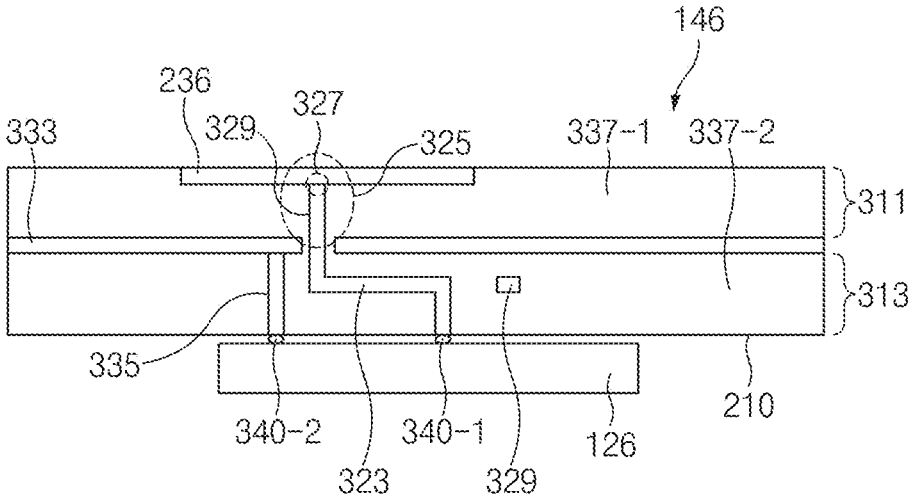
FIG. 3 illustrates a cross-sectional view of the third antenna module taken along the line B-B' of FIG. 2A according to an embodiment of the disclosure.

FIG. 3 illustrates a cross-sectional view of the third antenna module 146 taken along the line B-B' of FIG. 2A according to an embodiment of the disclosure. In the illustrated embodiment, the printed circuit board 210 may include an antenna layer 311 and a network layer 313 (e.g., an antenna structure).

Referring to FIG. 3, the antenna layer 311 may include at least one dielectric layer 337-1, and an antenna element 236 and/or a feed part 325 formed on an outer surface of the dielectric layer 337-1 or therein. The feed part 325 may include a feed point 327 and/or a signal line 329.

The network layer 313 may include at least one dielectric layer 337-2 and at least one ground layer 333, at least one conductive via 335, a transmission line 323, and/or a signal line 329 formed on an outer surface of the dielectric layer 337-2 or therein.

In addition, in the embodiment illustrated, the third RFIC 126 of FIG. 2C may be electrically connected with the network layer 313, for example, through first and second connection parts (e.g., solder bumps) 340-1 and 340-2. In various embodiments, various connection structures (e.g., soldering or a ball grid array (BGA)) may be utilized instead of the connection parts. The third RFIC 126 may be electrically connected with the antenna element 236 through the first connection part 340-1, the transmission line 323, and the feed part 325. Also, the third RFIC 126 may be electrically connected with the ground layer 333 through the second connection part 340-2 and the conductive via 335. Although not illustrated, the third RFIC 126 may also be electrically connected with the above module interface through a signal line 329.

Figure 4:
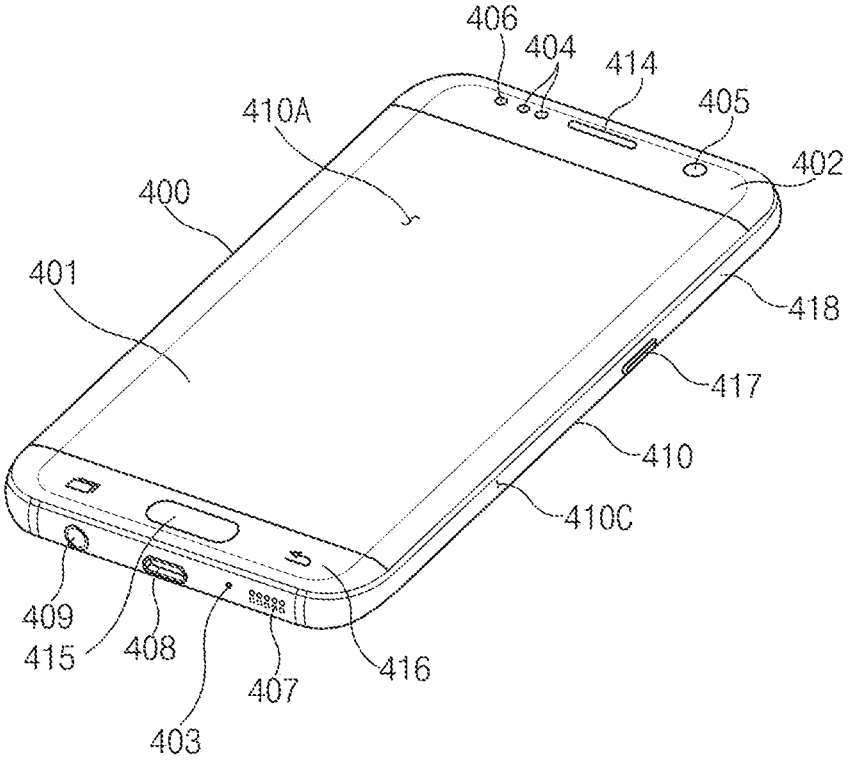
FIG. 4 is a view illustrating an example of an external appearance of a front surface of an electronic device, according to an embodiment of the disclosure.

FIG. 4 is a view illustrating an example of an external appearance of a front surface of an electronic device, according to an embodiment of the disclosure.

Figure 5:
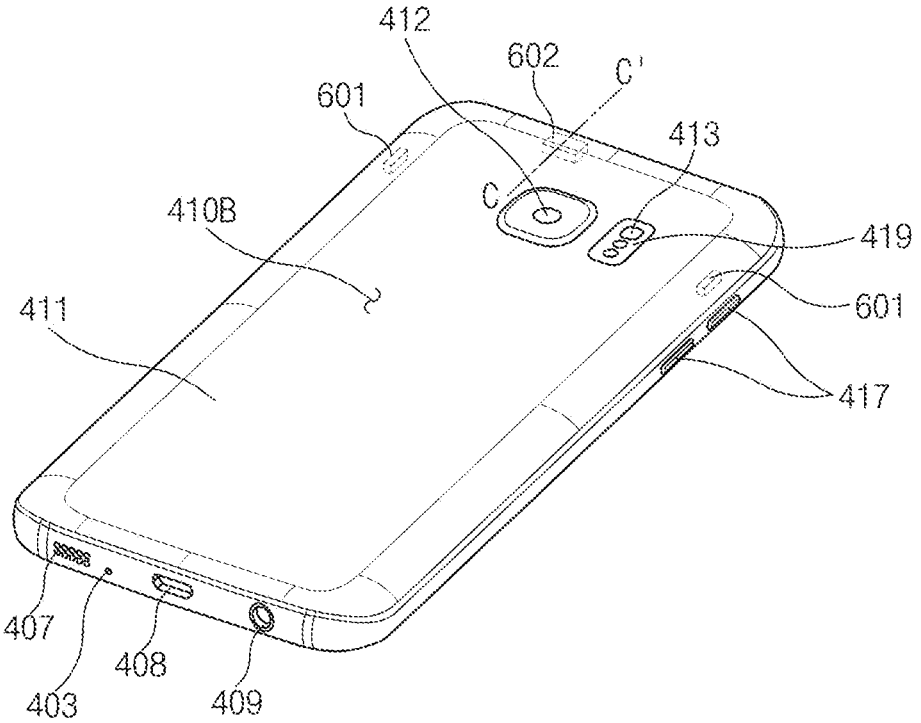
FIG. 5 is a view illustrating an example of an external appearance of a rear surface of an electronic device, according to an embodiment of the disclosure.

FIG. 5 is a view illustrating an example of an external appearance of a rear surface of an electronic device, according to an embodiment of the disclosure.

Referring to FIGS. 4 and 5, an electronic device 400 according to an embodiment may include a housing 410 including a first surface (or a front surface) 410A, a second surface (or a back surface) 410B, and a side surface 410C surrounding a space between the first surface 410A and the second surface 410B. In another embodiment (not illustrated), a housing may be referred to as a "structure" which forms a part of the first surface 410A, the second surface 410B, and side surfaces 410C of FIG. 4. According to an embodiment, the first surface 410A may be formed by a first plate (or a front plate) 402 (e.g., a glass plate including various coating layers, or a polymer plate), at least a portion of which is substantially transparent. The second surface 410B may be implemented with a rear plate 411 that is substantially opaque. For example, the rear plate 411 may be implemented with a coated or colored glass, a ceramic, a polymer, a metal (e.g., aluminum, stainless steel (STS), or magnesium), or a combination of at least two of the materials. The side surface 410C may be coupled with the front plate 402 and the rear plate 411, and may be formed by a side bezel structure (or a "side member") 418 including metal and/or polymer. In any embodiment, the rear plate 411 and the side bezel structure 418 may be integrally formed and may include the same material (e.g., a metal material such as aluminum).

According to an embodiment, the electronic device 400 may include at least one or more of a display 401, an audio module (403, 407, 414), a sensor module (404, 419), a camera module (405, 412, 413), a key input device (415, 416, 417), an indicator 406, and a connector hole (408, 409). In any embodiment, the electronic device 400 may not include at least one (e.g., the key input device (415, 416, or 417) or the indicator 406) of the components or may further include any other component.

The display 401 may be exposed through a considerable portion of the front plate 402, for example. The display 401 may be coupled with a touch sensing circuit, a pressure sensor which may measure the intensity (or pressure) of a touch, and/or a digitizer detecting a magnetic stylus pen or may be positioned adjacent thereto.

The audio module (403, 407, or 414) may include a microphone hole 403 and a speaker hole (407, 414). A microphone for obtaining external sound may be disposed inside the microphone hole 403; in any embodiment, a plurality of microphones may be disposed inside the microphone hole 403. The speaker hole (407, 414) may include an external speaker hole 407 and a receiver hole 414 for call. In any embodiment, the speaker hole (407, 414) and the microphone hole 403 may be implemented with one hole, or a speaker (e.g., a piezo speaker) may be included without the speaker hole (407, 414).

The sensor module (404, 419) may generate an electrical signal or a data value corresponding to an internal operation state of the electronic device 400 or corresponding to an external environment state. The sensor module (404, 419) may include, for example, a first sensor module 404 (e.g., a proximity sensor) and/or a second sensor module (not illustrated) (e.g., a fingerprint sensor) positioned on the first surface 410A of the housing 410, and/or a third sensor module 419 (e.g., a hear rate monitor (HRM) sensor) positioned on the second surface 410B of the housing 410. The fingerprint sensor may be disposed on the second surface 410B as well as the first surface 410A (e.g., a home key button 415) of the housing 410. The electronic device 400 may further include a sensor module not illustrated, for example, at least one of a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor 404.

The camera module (405, 412, 413) may include a first camera device 405 disposed on the first surface 410A of the electronic device 400, and a second camera device 412 and/or a flash 413 disposed on the second surface 410B. The camera module (405, 412) may include one or more lenses, an image sensor, and/or an image signal processor. The flash 413 may include, for example, a light emitting diode (LED) or a xenon lamp. In any embodiment, two or more lenses (wide-angle and telephoto lens) and image sensors may be disposed on one surface of the electronic device 400.

The key input device (415, 416, 417) may include the home key button 415 disposed on the first surface 410A of the housing 410, a touch pad 416 disposed in the vicinity of the home key button 415, and/or a side key button 417 disposed on the side surface 410C of the housing 410. In another embodiment, the electronic device 400 may not include all or a part of the aforementioned key input device (415, 416, 417), and the key input device (415, 416, 417) not included may be implemented in the form of a soft key on the display 401.

The indicator 406 may be disposed, for example, on the first surface 410A of the housing 410. The indicator 406 may provide state information of the electronic device 400, for example, in the form of light, and may include an LED.

The connector hole (408, 409) may include the first connector hole 408 that is able to accommodate a connector (e.g., a universal serial bus (USB) connector) for transmitting/receiving a power and/or data with an external electronic device, and/or the second connector hole (or an earphone jack) 409 that is able to accommodate a connector for transmitting/receiving an audio signal with the external electronic device.

Referring to FIG. 5, at least one or more antenna modules 601 and 602 may be disposed in the electronic device 400. For example, as illustrated in FIG. 5, the antenna modules 601 and 602 may be interposed between the front plate 402 and the rear plate 411 disposed on the rear surface 410B of the electronic device 400. According to an embodiment, the first antenna module 601 among the antenna modules 601 and 602 may be disposed adjacent to the side member of the electronic device 400.

According to various embodiments, the second antenna module 602 may be interposed between the front plate 402 (or the first plate) and the rear plate 411 (or the second plate); the second antenna module 602 may be disposed to form a beam in a direction facing the rear surface 410B. According to an embodiment, the surface facing the direction in which the beam of the second antenna module 602 is formed may face the inner surface of the rear plate 411. When the interval between the second antenna module 602 and the rear plate 411 is uniform, the signal emitted from the second antenna module 602 may have a specified characteristic. For example, as described in FIG. 2A above, when a plurality of patch antennas (or antenna elements or conductive patterns) are arranged in the second antenna module 602 at regular intervals, the patch antenna having a different interval between the second antenna module 602 and the rear plate 411 may indicate signal characteristics different from those of the surrounding patch antenna.

Figure 6:
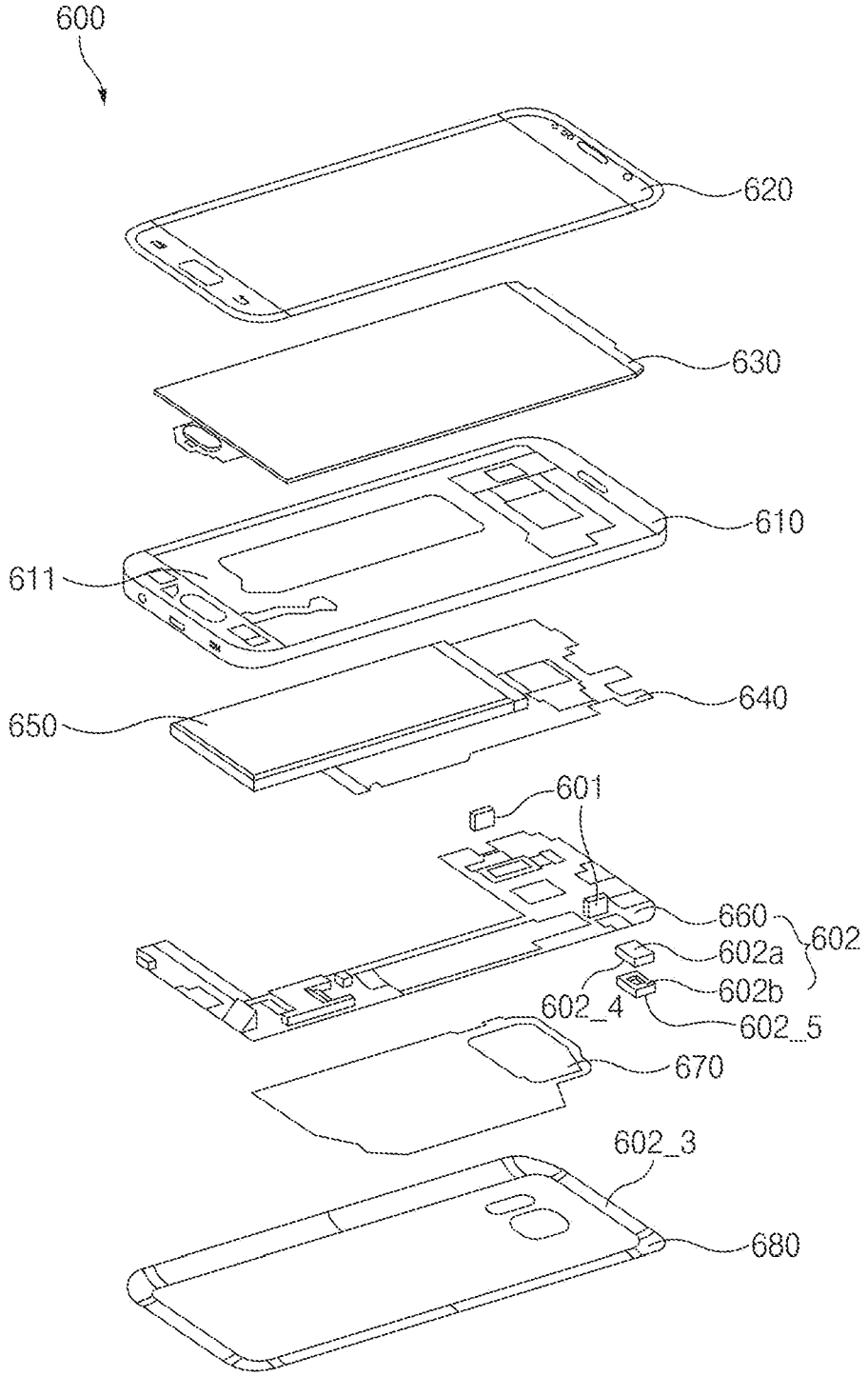
FIG. 6 is a block diagram illustrating an example of a structure in which an electronic device is disassembled, according to an embodiment of the disclosure.

FIG. 6 is a block diagram illustrating an example of a structure in which an electronic device is disassembled, according to an embodiment of the disclosure.

Referring to FIG. 6, an electronic device 600 may include a side bezel structure 610, a first support member 611 (e.g., a bracket), a front plate 620 (or an external protective layer), a display 630, a printed circuit board 640, a battery 650, a second support member 660 (e.g., a rear case), an antenna 670, and a rear cover 680 (or the rear plate 411). In any embodiment, the electronic device 600 may not include at least one (e.g., the first support member 611 or the second support member 660) of the components or may further include any other component. At least one of the components of the electronic device 600 may be identical or similar to at least one of the components of the electronic device 400 of FIG. 4 or 5, and thus, additional description will be omitted to avoid redundancy.

The first support member 611 may be disposed inside the electronic device 600, and may be connected with the side bezel structure 610 or may be integrally formed with the side bezel structure 610. The first support member 611 may be formed of, for example, a metal material and/or a nonmetal material (e.g., polymer). The display 630 may be coupled with one surface of the first support member 611, and the printed circuit board 640 may be coupled with an opposite surface of the first support member 311. A processor, a memory, and/or an interface may be mounted on the printed circuit board 640. For example, the processor may include one or more of a central processing unit, an application processor, a graphic processing device, an image signal processor, a sensor hub processor, or a communication processor.

The memory may include, for example, a volatile memory or a nonvolatile memory.

The interface may include, for example, a high definition multimedia interface (HDMI), a USB interface, a secure digital (SD) card interface, and/or an audio interface. The interface may electrically or physically connect, for example, the electronic device 600 with an external electronic device and may include a USB connector, an SD card/multi-media card (MMC) connector, or an audio connector.

The battery 650 that is a device for supplying power to at least one component of the electronic device 600 may include, for example, a primary cell incapable of being recharged, a secondary cell rechargeable, or a fuel cell. At least part of the battery 650 may be disposed on substantially the same plane as the PCB 640, for example. The battery 650 may be integrally disposed within the electronic device 600, or may be disposed to be removable from the electronic device 600.

The antenna 670 may be interposed between the rear cover 680 and the battery 650. The antenna 670 may include, for example, a near field communication (NFC) antenna, an antenna for wireless charging, and/or a magnetic secure transmission (MST) antenna. For example, the antenna 670 may perform short range communication with an external device or may wirelessly transmit/receive a power necessary to charge. In another embodiment, an antenna structure may be formed by a part of the side bezel structure 610 and/or the first support member 611, or by a combination thereof.

According to an embodiment, the antenna modules 601 and 602 may establish a communication path with at least part of a configuration (e.g., at least one wireless communication circuit of the third RFIC 126 and the fourth RFIC 128) of the wireless communication module (e.g., the wireless communication module 192 of FIG. 1) disposed on the printed circuit board 640, while being electrically connected to the printed circuit board 640.

According to an embodiment, one surface of the second antenna module 602 may be disposed in the direction of the rear surface 410B of the side bezel structure 610. For example, the surface facing the direction in which the second antenna module 602 forms beam may be disposed to face the inner surface of the rear cover 680. The second antenna module 602 may include a spacer structure 602*b* such that the interval between the antenna structure 602*a* (or an antenna structure body) disposed in the second antenna module 602 and the rear cover 680 is not less than a specified distance.

According to an embodiment, the spacer structure 602*b* may be formed to be disposed (e.g., bonded or deposited) on the antenna structure 602*a* (e.g., mmWave antenna structure) and to have a specific height. According to various embodiments, the spacer structure 602*b* may be formed separately and may be interposed between the antenna structure 602*a* and the rear cover 680. An adhesive layer (e.g., a first adhesive layer 602_4) may be interposed between the spacer structure 602*b* and the antenna structure 602*a*.

According to various embodiments, the spacer structure 602*b* may be disposed on the rear cover 680. An adhesive layer (e.g., a second adhesive layer 602_5) may be further interposed between the spacer structure 602*b* and the rear cover 680. The rear cover 680 may be coupled to cover the rear surface of the electronic device 600, and the spacer structure 602*b* may be disposed to be aligned with the antenna structure 602*a*. At least part of the rear cover 680 (or the rear plate 411 of FIG. 5) may include a non-conductive portion 602_3.

Figure 7A:
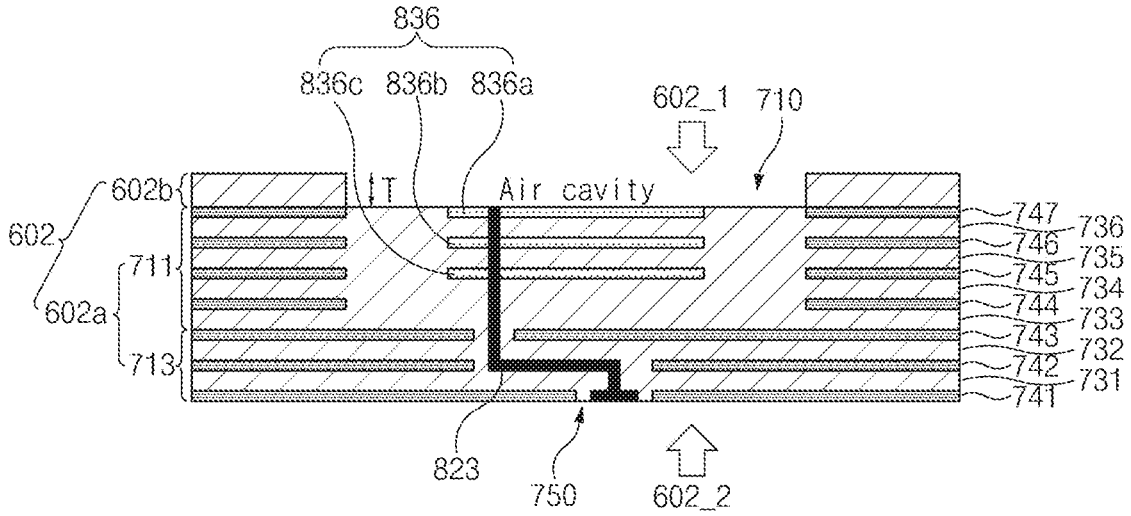
FIGS. 7A and 7B are diagrams illustrating an example of a configuration of a part of an electronic device among cross sections corresponding to a cut line C-C' of FIG. 5 according to various embodiments of the disclosure.
Figure 7B:
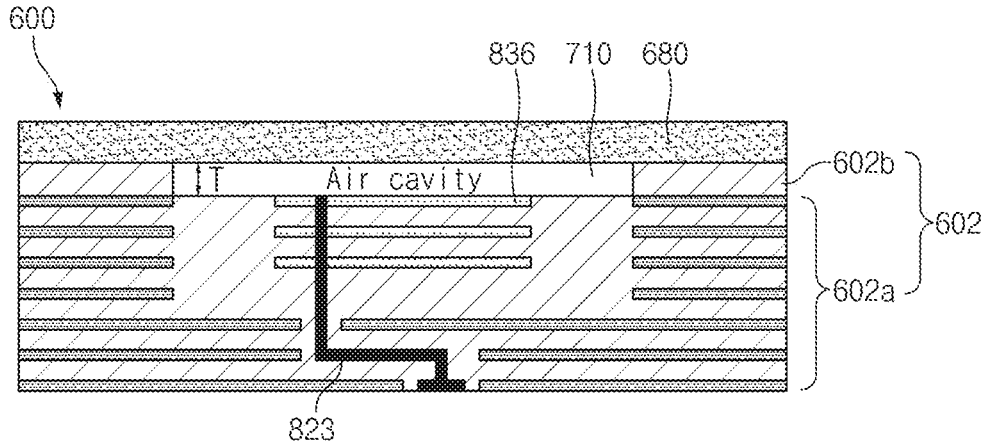

FIGS. 7A and 7B are diagrams illustrating an example of a configuration of a part of an electronic device in the cross section corresponding to a cut line C-C' of FIG. 5 according to various embodiments of the disclosure. FIGS. 7A and 7B are diagrams illustrating the second antenna module 602 and the rear cover 680 according to various embodiments of the disclosure.

For convenience of description, the illustrated drawing shows at least part of the second antenna module 602 and a part of the rear cover 680. However, the disclosure is not limited thereto. For example, as described with reference to FIGS. 1 to 6, the electronic device may further include a printed circuit board connected to the second antenna module, housing, in which the second antenna module and the printed circuit board are seated and which at least includes a first plate (e.g., the front plate 402) and a second plate (e.g., the rear plate 411) facing an opposite direction to the first plate, a display seated on one side of the housing, and at least one of a rear case and a rear plate surrounding at least part of the printed circuit board.

Referring to FIG. 7A, the second antenna module 602 may be formed in the PCB design scheme. According to an embodiment, the second antenna module 602 may include the antenna structure 602*a* and the spacer structure 602*b*. The antenna structure 602*a* may include an antenna layer 711 (e.g., the antenna layer 311 of FIG. 3) and a network layer 713 (e.g., the network layer 313 of FIG. 3). The antenna layer 711 may include at least one of at least one dielectric layer (733~736), at least one metal pattern layer (744~747), at least one patch antenna 836 (e.g., the antenna element 236 of FIG. 3), and at least part of a feed line 823. The network layer 713 may include at least one of at least one dielectric layer (731, 732), a ground layer 743, at least one metal pattern layer (741~742), and the remaining parts of the feed line 823.

The dielectric layers 731, 732, 733, 734, 735, and 736 and the metal pattern layers 741, 742, 743, 744, 745, 746, and 747 may be stacked alternately. For example, after a specific dielectric layer is formed and then a metal pattern layer is formed on the specific dielectric layer, an operation in which a dielectric layer is formed on the metal pattern layer again may be repeated during the specified number of times. The number of dielectric layers 731, 732, 733, 734, 735, and 736 and the number of metal pattern layers 741, 742, 743, 744, 745, 746, and 747 may vary. According to an embodiment, at least part of the repeating arrangement structure of the dielectric layers 731, 732, 733, 734, 735, or 736 and the metal pattern layers 741, 742, 743, 744, 745, 746, or 747 may be formed in the specified region, for example, the surrounding region other than the region where the patch antenna 836 is formed. The metal pattern layers 741 and 742 of the antenna structure 602*a* and the dielectric layers 731 and 732 may be alternately stacked with respect to the illustrated drawing. Afterward, after the metal pattern layer 743 (e.g., ground) is formed on the dielectric layer 732 and then the dielectric layer 733 is formed on the metal pattern layer 743, the metal pattern layer 744 may be formed on the dielectric layer 733; the metal pattern layer 744 may be formed in the surrounding region of the patch antenna 836 other than the region where the patch antenna 836 is formed. The dielectric layer 734 may be formed on the metal pattern layer 744, and the metal pattern layer 745 and the third patch antenna 836*c* may be formed on the dielectric layer 734 to be spaced at a specific interval. The metal pattern layer 745 may be formed in the surrounding region of the region where the patch antenna 836*c* is formed. As in the above description, the metal pattern layers 746 and 747 may be formed on the dielectric layer 735 and the dielectric layer 736, respectively. The second patch antenna 836*b* and/or the first patch antenna 836*a* may be formed on the dielectric layer 735 and the dielectric layer 736, respectively. At least part of the metal pattern layers 741, 742, 743, 744, 745, 746, and 747 may be used as the ground region GND of the patch antenna 836. At least part of the metal pattern layers 741, 742, 743, 744, 745, 746, and 747 may be connected to the ground through a via (not illustrated, the form similar to the conductive via 335 of FIG. 3) and may operate as the ground.

The feed line 823 may penetrate at least part of the metal pattern layers 741, 742, and 743 and the dielectric layers 731, 732, 733, 734, 735, and 736 through a via hole 750 formed in at least part of the metal pattern layers 741, 742, and 743 and may be electrically connected to the first to third patch antennas 836*a*, 836*b*, and 836*c*. The feed line 823 may feed the patch antenna 836. According to various embodiments, the antenna layer 711 is exemplified as a structure in which the first to third patch antennas 836*a*, 836*b*, and 836*c* are disposed, but the disclosure is not limited thereto. For example, the antenna layer 711 may include only the single patch antenna. Alternatively, even though the three patch antennas 836*a*, 836*b*, and 836*c* are disposed in the antenna layer 711, the feed line 823 may be electrically connected to only the single patch antenna (e.g., the first patch antenna 836*a*).

According to an embodiment, the patch antenna 836 may be formed on the same layer as other metal pattern layers (e.g., some metal pattern layers 745, 746, and 747) and may be electrically connected to the feed line 823. As illustrated in FIG. 2A, the plurality of patch antennas 836 may be disposed to be spaced apart from one another at regular intervals. At least part of the patch antenna (e.g., the first patch antenna 836*a*) disposed on the uppermost layer among the patch antennas 836 may have a state exposed to air. In the above description, an embodiment is exemplified as the three patch antennas 836 are respectively stacked on dielectric layers. However, the disclosure is not limited thereto.

In an embodiment, the spacer structure 602*b* may surround the periphery of the region where the patch antenna 836 is disposed and may be formed to have a specific height. The spacer structure 602*b* may be formed substantially the same method as the method in which the dielectric layer is formed, and may be formed to have a specific height using a material after being masked not to overlap with the region where the patch antenna 836 is disposed. The height of the spacer structure 602*b* may have a minimum height such that signal characteristics of the patch antenna 836 are capable of being maintained above a specified value. For example, the minimum height may vary depending on the size of the patch antenna 836, the shape of the patch antenna 836, the thickness of the patch antenna 836, the location of the patch antenna 836, the stack form of the patch antenna 836, or the stacked number of the patch antennas 836. As such, the minimum height may be obtained experimentally or statistically.

In general, the resonance frequency of the mm-Wave antenna may be designed based on the boundary condition in air (dielectric constant 1). The mm-wave antenna included in a thin electronic device (e.g., smartphone) is covered with a material having a specific dielectric constant face-to-face; the input impedance of the antenna may be changed due to the change in the air cavity 710 (or air gap) between the adjacent material and the antenna. For example, the resonance frequency may be changed due to the change in the input impedance of the antenna; impedance mismatching may increase; accordingly, the efficiency may be worsened seriously. According to an embodiment, as the dielectric constant of the material in contact with the mm-wave antenna face-to-face increases, the resonant frequency shift and the degree of mismatch may increase. The spacer structure 602*b* may be disposed to constantly maintain the air cavity 710 between the antenna structure 602*a* and the surrounding configuration (e.g., housing) when the mm-wave antenna (e.g., the antenna structure 602*a*) is mounted on a device (e.g., an electronic device or a smartphone) such that the antenna structure 602*a* according to an embodiment reduces the variation in the radiation performance caused by the tolerance in the manufacturing operation and constantly maintains the radiation performance dispersion characteristics between the same products in mass production.

Referring to FIG. 7B, in the electronic device 600 according to an embodiment, the rear cover 680 may be disposed on one side (e.g., the upper portion of the second antenna module 602 based on the illustrated drawing) of the second antenna module 602. For example, the rear cover 680 may be the rear cover, rear glass, or the like of the electronic device 600. In the electronic device 600, the spacer structure 602*b* may be disposed in a surrounding portion of the patch antenna 836. The spacer structure 602*b* may allow a specific interval between the rear cover 680 and the antenna structure 602*a* or the patch antenna 836 to be maintained. The electronic device 600 may uniformly maintain the resonant frequency and impedance matching characteristics of the patch antenna 836 by the air cavity 710 maintained by the spacer structure 602*b*. For example, the spacer structure 602*b* may be a tape (alternatively, an adhesive tape or an adhesive film) For another example, the spacer structure 602*b* may be formed in the form in which a part of the rear cover of the injection shape or the rear cover 680 protrudes.

Figure 8A:
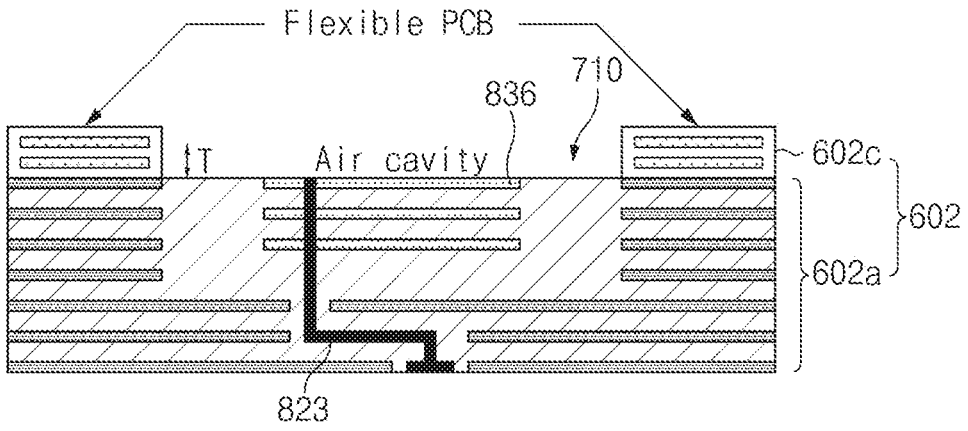
FIGS. 8A and 8B are diagrams illustrating another example of a second antenna module, according to various embodiments of the disclosure.
Figure 8B:
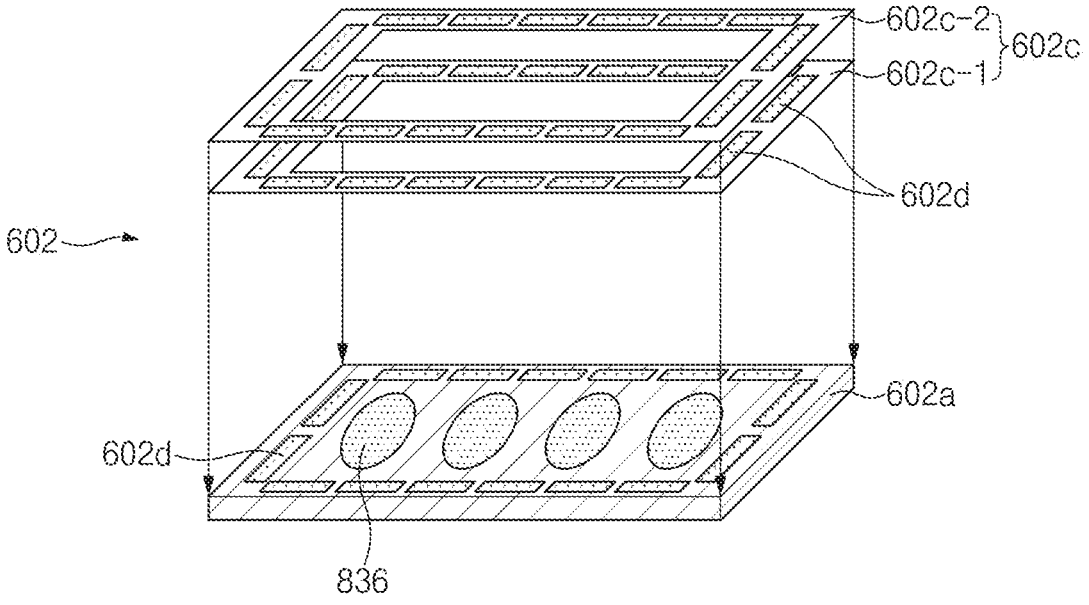

FIGS. 8A and 8B are diagrams illustrating another example of a second antenna module, according to various embodiments of the disclosure.

Referring to FIG. 8A, the second antenna module 602 of the disclosure may include an antenna structure 602*a* and a stacked spacer structure 602*c* (or FPCB used as a stacked spacer structure).

The antenna structure 602*a* may include at least one of a plurality of dielectric layers (e.g., the dielectric layers 731, 732, 733, 734, 735, and 736 of FIG. 7A) and metal pattern layers (e.g., the metal pattern layers 741, 742, 743, 744, 745, 746, and 747 of FIG. 7A), the patch antenna 836, and the feed line 823. In the above structure, the structure of the dielectric layers 731, 732, 733, 734, 735, and 736, the metal pattern layers 741, 742, 743, 744, 745, 746, and 747, the patch antenna 836, and the feed line 823 may be formed to be the same as or similar to the structure described above with reference to FIG. 7A.

According to various embodiments, the stacked spacer structure 602*c* may be disposed in a surrounding portion of the antenna structure 602*a* or the patch antenna 836 and may have the stacked structure of at least one FPCB in which a portion corresponding to the region of the patch antenna 836 is formed in the via band shape. The illustrated drawing illustrates a shape in which the layers of two FPCBs 602*c*-1 and 602*c*-2 are stacked. The number of FPCBs 602*c*-1 and 602*c*-2 may vary depending on the thickness of the air cavity 710 to be secured. For example, the number of the FPCBs 602*c*-1 and 602*c*-2 may vary according to the size of the patch antenna 836, the frequency band operated through the patch antenna 836, the shape of the patch antenna 836, the thickness of the patch antenna 836, the location of the patch antenna 836, the stacked form of the patch antenna 836, or the stacked number of the patch antennas 836.

Referring to FIG. 8B, according to various embodiments, the coupling member 602*d* (alternatively, a solder part or surface mounted device (SMD) (or surface mount technology (SMT) pads)) between a plurality of FPCBs 602*c*-1 and 602*c*-2 may be disposed in the stacked spacer structure 602*c*. The coupling member 602*d* may be interposed between the antenna structure 602*a* and the FPCBs 602*c*-1 and 602*c*-2. For example, the coupling member 602*d* may be disposed in at least part of the region other than the region, where the patch antenna 836 is disposed, in the upper surface of the antenna structure 602*a* based on the illustrated drawing. In an embodiment, the coupling member 602*d* may be disposed in a band shape. For another example, the coupling member 602*d* may have a specific interval and may be disposed on one side of the upper surface of the antenna structure 602*a* in a band shape. After the coupling member 602*d* is disposed, in a chamber environment at a specific temperature, the coupling member 602*d* may firmly fix the gap between the FPCBs 602*c*-1 and 602*c*-2 or the gap between the FPCBs 602*c*-1 and 602*c*-2 and the antenna structure 602*a*.

The stacked spacer structure 602*c* according to an embodiment may adjust the thickness 'T' of the air cavity 710 depending on the thickness of a single layer or the number of single layers among the FPCBs 602*c*-1 and 602*c*-2 and may flexibly change the thickness or the number of layers of the FPCBs 602*c*-1 and 602*c*-2 depending on mounting conditions. According to an embodiment, when the antenna module that takes a relatively long time to manufacture is manufactured or changed, the required air cavity 710 may be easily formed using the above-described FPCBs and 602*c*-2. In the operation of forming the stacked spacer structure 602*c* through the FPCBs 602*c*-1 and 602*c*-2, the air cavity 710 may be formed while the fine height is controlled through multiple layers using the repetitive SMD operation or the air cavity 710 may be formed by applying SMD fixation after the plurality of single-layer FPCBs 602*c*_1, 602*c*-2 of a specific thickness are disposed at a time.

According to various embodiments, an electronic device may include a housing (the housing 410 of FIG. 4 or the side bezel structure 610 of FIG. 6) including a first plate (e.g., the first plate or the front plate 402 of FIG. 4), a second plate (e.g., the second plate of FIG. 5 or the rear plate 411 of FIG. 4) disposed to face away from the first plate, and a side member (e.g., the side surface 410C of FIG. 4) surrounding a space between the first plate and the second plate and coupled with the second plate or integrally formed with the second plate, a display (e.g., the display 401 of FIG. 4 or the display 630 of FIG. 6) exposed through at least part of the first plate, an antenna structure body (e.g., the antenna structure 602*a* of FIG. 6) disposed inside the housing and including a first surface (e.g., surface 602_1 of FIG. 7A) facing the non-conductive portion and a second surface (e.g., surface 602_2 of FIG. 7A) facing away from the first surface, a spacer structure (e.g., the spacer structure 602*b* of FIG. 6) coupled with the first surface or integrally formed with the antenna structure body to protrude from the first surface without overlapping with the conductive pattern when viewed from above the first surface, and a wireless communication circuit (e.g., at least one of the third RFIC 126 and the fourth RFIC 128 of FIG. 1) electrically connected to the conductive pattern and configured to transmit and/or receive a signal having a frequency between 3 GHz and 100 GHz. At least part of the first plate, the second plate, or the side member may include a non-conductive portion (e.g., at least part of the non-conductive portion 602_3 of FIG. 6 or the rear plate 411 of FIG. 5). The antenna structure body (e.g., the antenna structure 602*a* of FIG. 6) may include at least one conductive pattern (e.g., at least one of the plurality of antenna elements 232, 234, 236, and 238 of FIG. 2A) disposed between the first surface and the second surface or on the first surface.

According to various embodiments, the spacer structure may include at least one conductive structure (e.g., the coupling member 602*d* of FIG. 8B).

According to various embodiments, when viewed from above the first surface, the spacer structure may be disposed to at least partially surround the conductive pattern.

According to various embodiments, the spacer structure may be disposed to contact the non-conductive portion.

According to various embodiments, the spacer structure may be formed to protrude from the first surface by 0.3 mm to 1.5 mm.

According to various embodiments, an electronic device according to an embodiment may include a housing (e.g., the side bezel structure 610 of FIG. 6) a display (e.g., the display 630 of FIG. 6) disposed on a front surface of the housing, a rear cover (e.g., the rear cover 680 of FIG. 6) disposed on a rear surface of the housing, an antenna structure (e.g., the antenna structure 602*a* of FIG. 6) (or antenna structure body)) positioned between the display and the rear cover and supporting a frequency band operated in at least a 5G communication scheme, and a spacer structure (e.g., the spacer structure 602*b* of FIG. 6) interposed between the antenna structure and the rear cover.

According to various embodiments, the electronic device may further include a first adhesive layer (e.g., the adhesive layer 602_4 of FIG. 6) interposed between the spacer structure and the antenna structure.

According to various embodiments, the spacer structure may be formed in a band shape. The center portion of the spacer structure is empty. The first adhesive layer may be interposed between one surface of the spacer structure in the band shape and the surrounding portion of a region where a patch antenna is disposed in the antenna.

According to various embodiments, the electronic device may further include a second adhesive layer (e.g., the adhesive layer 602_5 of FIG. 6) interposed between the spacer structure and the rear cover.

According to various embodiments, the spacer structure may be vertically aligned in the antenna structure.

According to various embodiments, when viewed from above the rear cover, a center portion of the spacer structure is aligned such that at least part of a patch antenna (e.g., at least one of the antenna elements 232, 234, 236, and 238 of FIG. 2A) included in the antenna structure is exposed.

According to various embodiments, the antenna structure may include a printed circuit board (e.g., 210 of FIG. 2A) in which a dielectric layer (e.g., at least one of 731 to 736 of FIGS. 8A and 8B) and a metal pattern layer (e.g., at least one of 741 to 747 of FIGS. 8A and 8B) are stacked alternately and a plurality of patch antennas disposed on the printed circuit board to be spaced by a specific interval. The spacer structure may be disposed at a surrounding portion of the plurality of patch antennas.

According to various embodiments, the spacer structure may be disposed to surround the plurality of patch antennas disposed at a center portion of the antenna structure and may be formed in a direction of the rear cover by a specified height.

According to various embodiments, the spacer structure may be formed in a band shape having a specific height.

According to various embodiments, the spacer structure may include at least one of the spacer structure includes a FPCB (e.g., 602*c*-1 or 602*c*-2 of FIG. 8B) having a specific thickness.

According to various embodiments, the electronic device may further include a coupling member (e.g., 602*d* of FIG. 8B) interposed between the FPCB and a surrounding portion of a patch antenna.

According to various embodiments, the spacer structure may further include a coupling member interposed between the plurality of FPCBs.

According to various embodiments, the antenna may include a plurality of patch antennas, in each of which a dielectric layer and a metal pattern layer are stacked alternately and which are spaced from the metal pattern layer by a specific interval.

According to various embodiments, the spacer structure may surround a periphery of the patch antennas with the same material as the dielectric layer and may be formed as a plurality of layers by a specified height. At least one or more SMD pads may be interposed between the plurality of layers.

According to various embodiments, the specified height of the spacer structure may have a range from 0.1 mm to less than 1 mm.

According to various embodiments, the electronic device described above with reference to FIGS. 1 to 8 and the configurations of each of the electronic devices may be arranged as the configuration of the electronic device described in other drawings.

Figure 9:
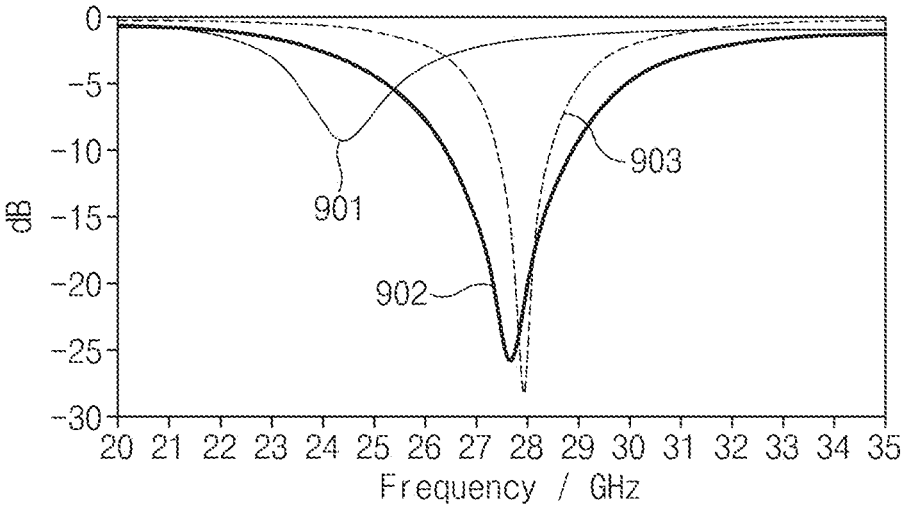
FIG. 9 illustrates an effect of a rear plate of a patch antenna operating at 28 GHz, according to an embodiment of the disclosure.

FIG. 9 illustrates an effect of a rear plate of a patch antenna operating at 28 GHz, according to an embodiment of the disclosure.

Referring to FIG. 9, graph 903 shows signal radiation characteristics in a situation where there is no separate peripheral structure in an antenna module having the impedance designed to operate in the band of 28 GHz. In the antenna module having a general patch antenna, the resonant frequency may be determined depending on the size, feed, and shorting location of a patch antenna.

Graph 901 shows signal characteristics in an environment where the antenna module representing the signal radiation characteristics in graph 903 faces the rear plate without a separate air cavity. As illustrated in FIG. 9, when an antenna module indicating a resonant frequency of 28 GHz is disposed without an interval with the rear plate (e.g., permittivity constant 3.5), it may be understood that the resonant frequency of the signal radiation characteristics of the antenna module is shifted to the band of 24 GHz depending on a boundary condition. Graph 902 shows the signal radiation characteristics of the antenna module adjusting the patch antenna size and feed position to adjust the operating frequency of the antenna module to 28 GHz being the design frequency in a state where the rear cover 680 is disposed. As described above, when there is no rear plate and air cavity, it may be difficult to obtain the signal radiation characteristics required to operate a communication module. An electronic device according to various embodiments may provide an environment in which signal radiation characteristics necessary to operate a communication module are capable of being easily obtained, by arranging an air cavity having a specified distance or more between an antenna module and a rear plate.

Figure 10:
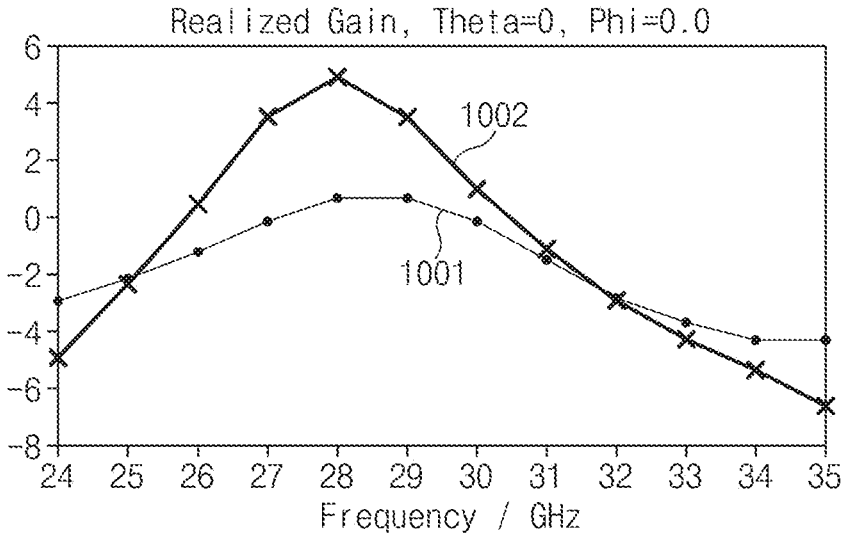
FIG. 10 shows an opened environment and radiation performance of a frequency-tuned antenna according to an embodiment of the disclosure.

FIG. 10 shows an opened environment and radiation performance of a frequency-tuned antenna according to various embodiments of the disclosure.

Referring to FIG. 10, graph 1001 shows the radiation performance of the second antenna module 602 in a state where the rear cover 680 is disposed; graph 1002 shows the radiation performance of the second antenna module 602 in a state where there is no rear cover 680. As shown in FIG. 10, in the band of 28 GHz, it may be understood that the radiation performance by the rear cover 680 is reduced. When the resonant frequency of the antenna module is adjusted again without an air cavity, it is possible to adjust the peak efficiency suitable for the operating frequency; it may be difficult to restore the radiation performance of the previous antenna due to the loss tangent by the permittivity of the rear cover 680.

Figure 11:
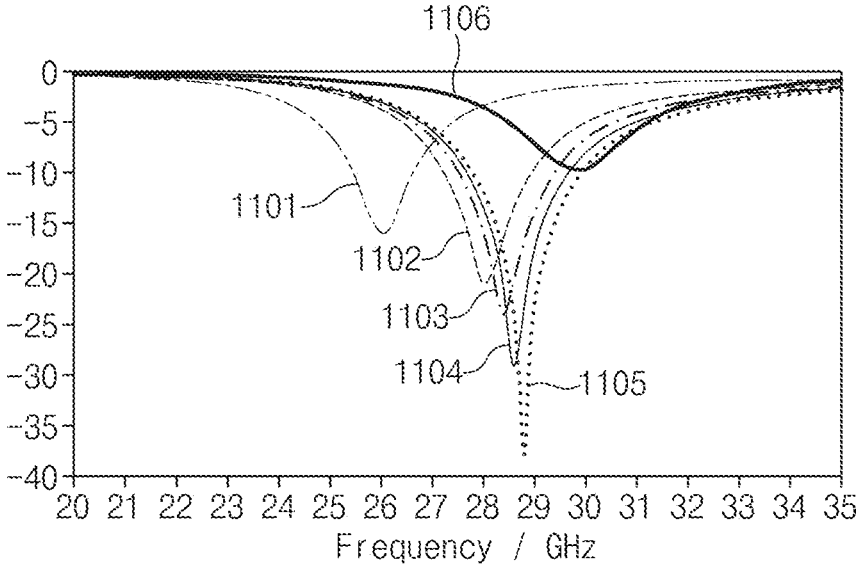
FIG. 11 illustrates radiation characteristics of an antenna module in which an air cavity is formed differently according to an embodiment of the disclosure.

FIG. 11 illustrates radiation characteristics of an antenna module in which an air cavity is formed differently according to an embodiment of the disclosure.

Figure 12:
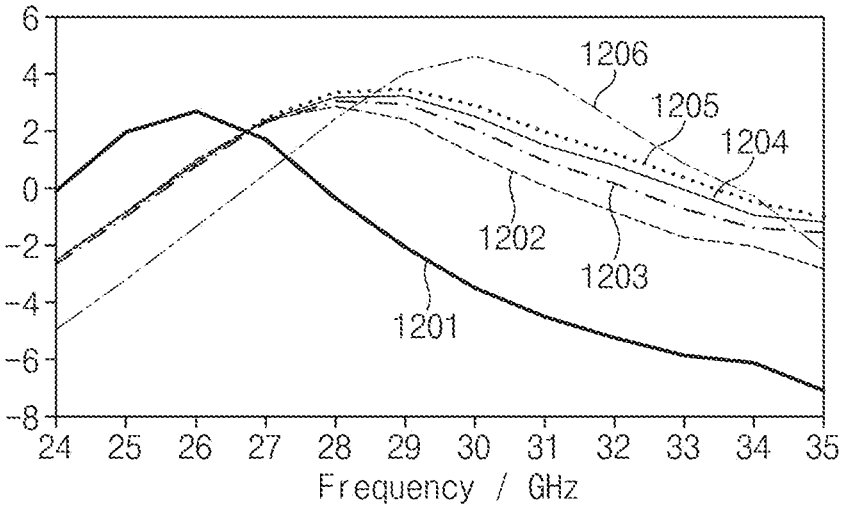
FIG. 12 illustrates impedance characteristics of an antenna module in which an air cavity is formed differently according to an embodiment of the disclosure.

FIG. 12 illustrates impedance characteristics of an antenna module in which an air cavity is formed differently according to an embodiment of the disclosure.

Referring to FIGS. 11 and 12, graph 1101 and graph 1201 show the antenna impedance characteristics and signal radiation characteristics in a state where there is no interval between the rear cover 680 and the second antenna module 602. Graph 1102 and graph 1202 show the antenna impedance characteristics and signal radiation characteristics in the antenna module in which the patch antenna size and feed location are tuned such that the interval between the rear cover 680 and the second antenna module 602 is 0.1 mm and the radiation characteristics exceed the specified value in the band of 28 GHz. Graph 1103 and graph 1203 show antenna impedance characteristics and signal radiation characteristics in a state where the interval between the antenna module and the rear cover 680, which are used in graph 1102, is 0.2 mm Graph 1104 and graph 1204 show antenna impedance characteristics and signal radiation characteristics in a state where the interval between the antenna module and the rear cover 680, which are applied to graph 1102, is 0.3 mm Graph 1105 and graph 1205 show antenna impedance characteristics and signal radiation characteristics in a state where the interval between the antenna module and the rear cover 680, which are applied to graph 1102, is 0.4 mm Graph 1106 and graph 1206 show the impedance characteristics and signal radiation characteristics of the antenna applied to graph 1102 in a state where the rear cover 680 is not present. When the rear cover 680 is to be removed from the antenna module designed for peak efficiency in the band of 28 GHz, the peak efficiency may be changed to the band of 30 GHz as the surrounding effective permittivity is changed to the air permittivity. As indicated above, when the interval between the rear cover 680 (or the rear plate 411) and the second antenna module 602 is not less than 0.1 mm, it may be understood that the signal radiation characteristics are relatively good in the band of 28 GHz.

According to an embodiment, an electronic device may include a housing including a first plate (e.g., the front plate 402 of FIG. 4), a second plate (e.g., the rear plate 411 of FIG. 4) disposed to face away from the first plate, and a side member (e.g., the side surface 410C of FIG. 4) surrounding a space between the first plate and the second plate and coupled with the second plate or integrally formed with the second plate, a display (e.g., the display 630) exposed through at least part of the first plate, an antenna structure body (e.g., the second antenna module 602 of FIG. 6) disposed inside the housing and including a first surface facing the non-conductive portion and a second surface facing away from the first surface, a spacer structure (e.g., the spacer structure 602*b* of FIG. 6) coupled with the first surface or integrally formed with the antenna structure body to protrude from the first surface without overlapping with the conductive pattern when viewed from above the first surface, and a wireless communication circuit (e.g., the RFIC of FIG. 1) electrically connected to the conductive pattern and configured to transmit and/or receive a signal having a frequency between 3 GHz and 100 GHz. At least part of the first plate, the second plate, or the side member may include a non-conductive portion (e.g., the first support member 611 of FIG. 6). The antenna structure body may include at least one conductive pattern (e.g., the antenna elements 232, 234, 236, and 238 of FIG. 2A) disposed between the first surface and the second surface or on the first surface.

According to various embodiments, the spacer structure may include at least one conductive structure.

According to various embodiments, when viewed from above the first surface, the spacer structure may have a shape at least partially surrounding the conductive pattern.

According to various embodiments, the spacer structure may contact the non-conductive portion.

According to various embodiments, the spacer structure may have a structure that protrudes from the first surface by 0.3 mm to 1.5 mm.

According to various embodiments of the disclosure, an electronic device may form a specified air cavity with at least one configuration and an antenna module, thereby ensuring the performance of the specified antenna module.

Besides, a variety of effects directly or indirectly understood through the disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including a first plate, a second plate disposed to face away from the first plate, and a side member surrounding a space between the first plate and the second plate and coupled with the second plate or integrally formed with the second plate, wherein at least part of the first plate, the second plate, or the side member includes a non-conductive portion;

a display, at least a portion of the display is exposed through at least part of the first plate;

an antenna structure body disposed inside the housing and including a first surface facing the non-conductive portion and a second surface facing away from the first surface, wherein the antenna structure body includes at least one conductive pattern disposed between the first surface and the second surface or on the first surface;

a spacer structure coupled to the first surface or integrally formed with the antenna structure body to protrude from the first surface without overlapping with the at least one conductive pattern when viewed from above the first surface; and a wireless communication circuit electrically connected to the at least one conductive pattern and configured to transmit or receive a signal, wherein at least part of the spacer structure contacts the non-conductive portion of the housing.

2. The electronic device of claim 1, wherein the spacer structure includes at least one conductive structure.

3. The electronic device of claim 1, wherein the spacer structure is disposed to at least partially surround the at least one conductive pattern, when viewed from above the first surface.

4. The electronic device of claim 1, wherein at least part of the spacer structure protrudes from the first surface by 0.3 mm to 1.5 mm.

5. An electronic device comprising:

a housing;

a display disposed on a front surface of the housing;

a rear cover disposed on a rear surface of the housing;

an antenna structure positioned between the display and the rear cover and supporting a frequency band operated in at least a 5th generation (5G) communication scheme; and a spacer structure interposed between the antenna structure and the rear cover, wherein at least part of the spacer structure contacts a non-conductive portion of the housing.

6. The electronic device of claim 5, further comprising:

a first adhesive layer disposed between the spacer structure and the antenna structure.

7. The electronic device of claim 6, wherein a center portion of the spacer structure comprises a hole and the spacer structure is formed in a band shape, and wherein the first adhesive layer is interposed between a surface of the spacer structure and a surrounding portion of a region where a patch antenna is disposed, in the antenna structure.

8. The electronic device of claim 5, further comprising:

a second adhesive layer interposed between the spacer structure and the rear cover.

9. The electronic device of claim 5, wherein the spacer structure is vertically aligned in the antenna structure.

10. The electronic device of claim 5, wherein a center portion of the spacer structure is aligned such that at least part of a patch antenna included in the antenna structure is exposed, when viewed from above the rear cover.

11. The electronic device of claim 5, wherein the antenna structure includes:

a printed circuit board in which a dielectric layer and a metal pattern layer are stacked alternately, and a plurality of patch antennas disposed on the printed circuit board to be spaced by a specific interval, and wherein the spacer structure is disposed at a surrounding portion of the plurality of patch antennas.

12. The electronic device of claim 11, wherein the spacer structure is disposed to surround the plurality of patch antennas disposed at a center portion of the antenna structure and is formed in a direction of the rear cover by a specified height.

13. The electronic device of claim 5, wherein the spacer structure is formed in a band shape having a specific height.

14. The electronic device of claim 5, wherein at least part of the spacer structure includes a flexible printed circuit board (FPCB) having a specific thickness.

15. The electronic device of claim 14, further comprising:

a coupling member interposed between the FPCB and a surrounding portion of a patch antenna included in the antenna structure.

16. The electronic device of claim 5, wherein the spacer structure further includes:

a plurality of FPCBs; and a coupling member interposed between the plurality of FPCBs.

17. The electronic device of claim 5, wherein the antenna structure includes:

a plurality of patch antennas in each of which a dielectric layer and a metal pattern layer are stacked alternately and which are spaced from the metal pattern layer by a specific interval.

18. The electronic device of claim 17, wherein the spacer structure surrounds a periphery of the plurality of patch antennas with an identical material as the dielectric layer and is formed as a plurality of layers by a specific height, and wherein at least one or more surface mounted device (SMD) pads are interposed between the plurality of layers.

19. The electronic device of claim 18, wherein the specific height is greater than or equal to 0.1 mm and less than 1 mm.

* * * * *